US005087305A

United States Patent [19]

Chang

[11] Patent Number: 5,087,305

[45] Date of Patent: Feb. 11, 1992

[54] FATIGUE CRACK RESISTANT NICKEL BASE SUPERALLOY

[75] Inventor: Keh-Minn Chang, Schenectady, N.Y.

[73] Assignee: General Electric Company, Schenectady, N.Y.

[21] Appl. No.: 215,189

[22] Filed: Jul. 5, 1988

[51] Int. Cl.[5] ..... C22C 19/05

[52] U.S. Cl. ..... 148/410; 148/12.7 N

[58] Field of Search ..... 148/410, 12.7 N, 428; 420/448

[56] References Cited

U.S. PATENT DOCUMENTS

| | | | |
|---|---|---|---|
| 3,046,108 | 7/1962 | Eiselstein | 420/448 |
| 3,372,068 | 5/1968 | White et al. | 148/162 |
| 4,140,555 | 2/1979 | Garcia et al. | 148/32 |

FOREIGN PATENT DOCUMENTS

| | | |
|---|---|---|
| 260510 | 3/1988 | European Pat. Off. . |
| 2133186 | 2/1972 | Fed. Rep. of Germany . |
| 3427206 | 7/1985 | Fed. Rep. of Germany . |
| 2223470 | 3/1974 | France . |

*Primary Examiner*—R. Dean

*Attorney, Agent, or Firm*—Paul E. Rochford; James C. Davis, Jr.; James Magee, Jr.

[57] ABSTRACT

An alloy is disclosed which has been found to lend itself particularly well to thermomechanical processing. The alloy is strengthened by precipitates similar to those of Inconel 718 but the alloy matrix of the composition is a nickel-chromium-cobalt matrix rather than the nickel-chromium-iron matrix of the Inconel alloy. Also the alloy has grains of average diameter of 35 μm or larger. The fatigue resistance, tensile strength and the rupture strength of the alloy is improved to a remarkable degree as a result of the thermomechanical processing. The thermomechanical processing is carried out below the recrystallization temperature to prevent nucleation of fine grains. The residual strains from the thermomechanical processing or cold working provides the remarkably favorable combination of alloy properties which are found.

5 Claims, 8 Drawing Sheets

FATIGUE CRACK RESISTANT NICKEL BASE SUPERALLOY

RELATED APPLICATIONS

The subject application relates generally to the subject matter of applications Ser. Nos. 907,275 and 907,550, filed concurrently on Sept. 15, 1986 which applications are assigned to the same assignee as the subject application herein.

The texts of these related applications is incorporated herein by reference.

BACKGROUND OF THE INVENTION

It is well known that nickel based superalloys are extensively employed in high performance environments. Such alloys have been used extensively in jet engines and in gas turbines where they must retain high strength and other desirable physical properties at elevated temperatures of a 1000° F. or more.

The strength of these alloys is related to the presence of a strengthening precipitate, which in many cases is a δ' precipitate or δ'' precipitate. More detailed characteristics of the phase chemistry of precipitates are given in "Phase Chemistries in Precipitation-Strengthening Super-alloy" by E. L. Hall, Y. M. Kouh, and K. M. Chang [Proceedings of 41st. Annual Meeting of Electron Microscopy Society of America, August 1983 (p. 248)].

The following U.S. patents disclose various nickel-base alloy compositions, some of which contain such precipitates: U.S. Pat. No. 2,570,193; U.S. Pat. No. 2,621,122; U.S. Pat. No. 3,046,108; U.S. Pat. No. 3,061,426; U.S. Pat. No. 3,151,981; U.S. Pat. No. 3,166,412; U.S. Pat. No. 3,322,534; U.S. Pat. No. 3,343,950; U.S. Pat. No. 3,575,734; U.S. Pat. No. 3,576,681; U.S. Pat. No. 4,207,098 and U.S. Pat. No. 4,336,312. The aforementioned patents are representative of the many alloying situations reported to date in which many of the same elements are combined to achieve distinctly different functional relationships between the elements such that phases form which provide the alloy system with different physical and mechanical characteristics. Nevertheless, despite the large amount of data available concerning the nickel-base alloys, it is still not possible for workers in the art to predict with any degree of accuracy the physical and mechanical properties that will be displayed by certain concentrations of known elements used in combination to form such alloys even though such combination may fall within broad, generalized teachings in the art, particularly when the alloys are processed using heat treatments different from those previously employed.

A significant development in the alloys for use at high temperature was made in 1962 with the development of the IN718 alloy by H. L. Eiselstein at the International Nickel Company. The Eiselstein patent U.S. Pat. No. 3,046,108 resulted from this discovery and was the basis for the commercial production of the alloy IN718 which is still produced and used very extensively commercially. This alloy was characterized by the presence therein of a substantial quantity of δ'' precipitate. Studies of the alloy and of the precipitate are contained in the following papers:

"Alloy 718: The Workhorse of Superalloys", by Robert R. Irving, Iron Age, June 10, 1981;

"Metallurgy of a Columbium-Hardened Nickel-Chromium-Iron Alloy", by Eiselstein, Advances in the Technology of Stainless Steels, pp. 62-79;

"Identification of the Strengthening Phase in "Inconel" Alloy 718" by Kotval, Transactions of the Metallurgical Society of AIME, Vol. 242, August 1968, pp. 1764-65;

"Precipitation of Nickel-Base Alloy 718", by Paulonis et al., Transactions of the ASM, Vol. 62, 1969, pp. 611-622"

"Effect of Grain Boundary Denudation of Gamma Prime on Notch-Rupture Ductility of Inconel Nickel-Chromium Alloys X-750 and 718", by E. L. Raymond, Transactions of the Metallurgical Society of AIME, Vol. 239, Sept. 1967, pp. 1415-1422.

Essentially, no improvements were made in the alloy for approximately 25 years from the date when the Eiselstein application was filed on the IN718 alloy in November, 1958. Recently, however, a unique and unusual improvement was made in alloys which are strengthened by δ'' precipitate and the description of this new class of alloys resulting from the discovery is described in the UK Patent Application GB2148323A.

It is known that some of the most demanding sets of properties for superalloys are those which are needed in connection with jet engine construction. Of the sets of properties which are needed those which are needed for the moving parts of the engine are usually greater than those needed for static parts although the sets of needed properties are different for the different components of an engine.

Because some sets of properties have not been attainable in cast alloy materials, resort is sometimes had to the preparation of parts by powder metallurgy techniques. However, one of the limitations which attends the use of powder metallurgy techniques in preparing moving parts for jet engines is that of the purity of the powder. If the powder contains impurities such as a speck of ceramic or oxide the place where that speck occurs in the moving part becomes a latent weak spot where a crack may initiate or it becomes a latent crack.

To avoid problems with impure powder and similar problems it is sometimes preferred to form moving parts of jet engines such as disks with alloys which can be cast and wrought.

A problem which has been recognized to a greater and greater degree with many such nickel based superalloys is that they are subject to formation of cracks or incipient cracks, either in fabrication or in use, and that the cracks can actually initiate or propagate or grow while under stress as during use of the alloys in such structures as gas turbines and jet engines. The propagation or enlargement of cracks can lead to part fracture or other failure. The consequence of the failure of the moving mechanical part due to crack formation and propagation is well understood. In jet engines it can be particularly hazardous.

However, what has been poorly understood until recent studies were conducted was that the formation and the propagation of cracks in structures formed of superalloys is not a monolithic phenomena in which all cracks are formed and propagated by the same mechanism and at the same rate and according to the same parameters and criteria. By contrast the complexity of the crack generation and propagation and of the crack phenomena generally, and the interdependence of such propagation with the manner in which stress is applied, is a subject on which important new information has been gathered in recent years. The period during which stress is applied to a member to develop or propagate a crack, the intensity of the stress applied, the rate of application and of removal of stress to and from the member and the schedule of the application was not well understood in the industry until a study was conducted under contract to the National Aeronautics and Space Administration. This study is reported to a technical report identified as NASA CR-165123 issued from the National Aeronautics and Space Administration in August 1980, identified as "Evaluation of the Cyclic Behavior of Aircraft Turbine Disk Alloys", Part II, Final Report, by B. A. Cowles, J. R. Warren and F. K. Hauke, and prepared for the National Aeronautics and Space Administration, NASA Lewis Research Center, Contract NAS3-21379.

A principal unique finding of the NASA sponsored study was that the rate of propagation based on fatigue phenomena or in other words the rate of fatigue crack propagation (FCP) was not uniform for all stresses applied nor to all manners of applications of stress. More importantly, the finding was that fatigue crack propagation actually varied with the frequency of the application of stress to the member where the stress was applied in a manner to enlarge the crack. More surprising still, was the finding from the NASA sponsored study that the application of stress of lower frequencies rather than at the higher frequencies previously employed in studies, actually increased the rate of crack propagation. In other words the NASA study revealed that there was a time dependence in fatigue crack propagation. Further the time dependence of fatigue crack propagation was found to depend not on frequency alone but on the time during which the member was held under stress or a so-called hold-time.

Following the discovery of this unusual and unexpected phenomena of increased fatigue crack propagation at lower stress frequencies there was some belief in the industry that this newly discovered phenomena represented an ultimate limitation on the ability of the nickel based superalloys to be employed in the stress bearing parts of the turbines and aircraft engines and that all design effort had to be made to design around this problem.

However, it has been discovered that it is feasible to construct parts of nickel based superalloys for use at high stress in turbines and aircraft engines with greatly reduced crack propagation rates.

The development of the superalloy compositions and methods of their processing of this invention focuses on the fatigue property and addresses in particular the time dependence of crack growth.

Crack growth, i.e., the crack propagation rate, in high-strength alloy bodies is known to depend upon the applied stress ($\sigma$) as well as the crack length (a). These two factors are combined by fracture mechanics to form one single crack growth driving force; namely, stress intensity K, which is proportional to $\sigma\sqrt{a}$. Under the fatigue condition, the stress intensity in a fatigue cycle represents the maximum variation of cyclic stress intensity ($\Delta K$), i.e., the difference between $K_{max}$ and $K_{min}$. At moderate temperatures, crack growth is determined primarily by the cyclic stress intensity ($\Delta K$) until the static fracture toughness $K_{IC}$ is reached. Crack growth rate is expressed mathematically as $da/dN \propto (\Delta K)^n$. N represents the number of cycles and n is a constant which is between 2 and 4. The cyclic frequency and the shape of the waveform are the important parameters determining the crack growth rate. For a given cyclic stress intensity, a slower cyclic frequency can result in a faster crack growth rate. This undesirable time-dependent behavior of fatigue crack propagation can occur in most existing high strength superalloys. According to this hold time pattern, the stress is held for a designated hold time each time the stress reaches a maximum in following the normal sine curve. This hold time pattern of application of stress is a separate criteria for studying crack growth. This type of hold time pattern was used in the NASA study referred to above.

The design objective is to make the value of da/dN as small and as free of time-dependency as possible.

It is pointed out in copending application Ser. No. 907,550, filed Sept. 15, 1986 that time dependent fatigue crack propagation can be reduced significantly by a thermal treatment of $\delta'$ strengthened nickel base superalloys which have more than 35 volume percent of strengthening precipitate. As is pointed out in this copending application, the method involves a high temperature solutioning (supersolvus) solutioning of the $\delta'$ precipitate followed by a controlled cooling at less than 250° F. per minute.

However, it has been found that the method of copending application Ser. No. 907,550 does not yield the beneficial results taught in that application when the method is applied to alloys with low precipitate content. For example, the method does not produce the fatigue crack propagation reduction when applied to Waspalloy or to IN718 alloy. Waspalloy is $\delta'$ hardened and has less than 35 volume percent and preferably about 30 volume percent $\delta'$ precipitate. IN718 is mainly $\delta''$ hardened and has less than 35 volume percent and preferably about 20 percent by volume of $\delta'$ precipitate.

I have done extensive studies on alloys of such lower $\delta'$ or $\delta''$ precipitate content and have heat treated these alloys according to a variety of schedules which restrict fatigue crack propagation properties of alloys having higher precipitate content but without significant beneficial effect. I have found that none of these heat treatments develop different or advantageous microstructures or result in any significant reduction in fatigue crack propagation.

A second copending application Ser. No. 907,275, also filed Sept. 15, 1986, discloses a method for processing a superalloy containing a lower concentration of strengthening precipitate. The method of this copending application produces materials with a superior set or combination of properties for use in advanced engine disc applications. Properties which are conventionally needed for materials used in disc applications include high tensile strength and high stress rupture strength. These properties are achieved in the practice of the method of the copending application Ser. No. 907,275 and, in addition, the alloy prepared by the methods of the copending application exhibit a desirable property of resisting crack growth propagation. Such ability to resist crack growth in essential for the component low cycle fatigue life or LCF. In addition to this superior set of properties as outlined above, the alloy processed according to the method of the Ser. No. 907,275 copending application displays good forgeability and such forgeability permits greater flexibility in the use of various manufacturing processes needed in formation of parts such as discs for jet engines. Superalloys with lower ranges of precipitate content generally have good forgeability and can be subjected to thermomechanical processing. The differences in the results obtained by certain thermomechanical processings on mechanical properties, like strength and rupture life, are known to a degree. However, prior to the teaching of the copending application Ser. No. 907,275 nothing was known of the influence if any of thermomechanical processing on time-dependent fatigue crack propagation or the rates of such propagation.

As alloy products for use in turbines and jet engines have developed it has become apparent that different sets of properties are needed for parts which are employed in different parts of the engine or turbine. For jet engines, the material requirements of more advanced aircraft engines continue to become more strict as the performance requirement of the aircraft engines are increased. The different requirements are evidenced, for example, by the fact that many blade alloys display very good high temperature properties in the cast form. However, the direct conversion of cast blade alloys into disc alloys is very unlikely because blade alloys display inadequate strength at intermediate temperatures of about 700° C. Further, the blade alloys have been found very difficult to forge and forging has been found desirable in the fabrication of blades from disc alloys. Moreover, the crack growth resistance of disc alloys has not been evaluated.

Accordingly, to achieve increased engine efficiency and greater performance, constant demands are made for improvements in the strength and temperature capabilities of disc alloys as a special group of alloys for use in aircraft engines. Now, these capabilities must be coupled with low fatigue crack propagation rates and a low order of time dependency of such rates.

While the copending application Ser. No. 907,275 dealt with the improvements which could be made in existing alloys of low precipitate concentration through the thermomechanical processing, there was no disclosure of any alloy in the copending application which was particularly adapted to be benefitted by the application of the thermomechanical processing of the copending application or of novel results of the application of such processing to an alloy so adapted.

The present invention provides a alloy which is particularly adapted and suited to the processing by thermomechanical treatment taught in the copending application to achieve a unique and remarkable combination and set of properties.

BRIEF DESCRIPTION OF THE INVENTION

It is accordingly one object of the present invention to provide nickel-base superalloy products which are more resistant to cracking.

Another object is to provide novel alloy which is particularly suited to increasing the high temperature capability thereof.

Another object is to provide articles for use under cyclic high stress which are more resistant to rupture.

Another object is to provide a method for reducing the time dependency of fatigue cracking in combination with unique alloys having higher strength.

Another object of the present invention to provide the combination of a novel composition and method which permits the novel superalloys to display increased strength and increased rupture properties.

Another object is to provide an alloy which has principally precipitate strengtheners adapted to be processed into a condition in which the high temperature capabilities of the alloy is emphasized.

Other objects will be in part apparent and in part pointed out in the description which follows.

In one of its broader aspects, objects of the present invention can be achieved by providing an alloy having a composition in weight percent essentially as follows:

| Ingredient | Concentration in weight percent | |
|---|---|---|
| | From about | To about |
| Nickel | balance | |
| Chromium | 16 | 22 |
| Cobalt | 8 | 14 |
| Molybdenum | 2.0 | 4.0 |
| Aluminum | 0.2 | 0.9 |
| Titanium | 0.5 | 1.5 |
| Tantalum | 3.5 | 4.5 |
| Niobium | 3.5 | 4.5 |
| Carbon | 0.0 | 0.05 |
| Boron | 0.002 | 0.015 |

The alloy of the present invention is strengthened by precipitates similar to those of Inconel 718. However, the alloy matrix of the composition is a nickel-chromium-cobalt matrix rather than the nickel-chromium-iron matrix of the Inconel 718 alloys.

By balance nickel as used herein it is meant that the balance is predominantly nickel but that the composition may contain minor amounts of other elements such as iron, magnesium and other elements as impurities or as minor additives so long as the presence of the other elements does not detract from or interfere with the beneficial properties of the alloy as taught herein.

The alloy, which is set out above, has been found to be particularly suited and adapted to receive the thermomechanical processing treatments as set for the in copending application Ser. No. 907,275 which application is incorporated herein by reference. The result of the development of this designated composition and the application of the thermomechanical processing is to achieve a composition with crack growth resistance that has improved high temperature strength and temperature capability superior to commercial alloys which have received the benefit of the thermomechanical processing described in the copending U.S. Ser. No. 907,275 application.

It should be emphasized that the novelty of the subject invention resides principally in the finding that this alloy, when coupled with the thermomechanical processing of the copending application, yields unique and novel properties. Novelty exists because the application of the same thermomechanical processing to other alloys does not permit the achievement of the superior strength and combination of other properties developed in the subject alloy. In fact, there is no other alloy known to the inventor which has the capacity for achieving the combination of strength and other properties which the alloy of this invention can achieve through the thermomechanical processing.

The sample is then given a solution heat treatment at a temperature above the recrystallization temperature if the grain structure of the alloy is smaller grains of average diameter of less than 35 μm. The sample may be aged following the solution heat treatment.

The sample must have acquired a recrystallized equiaxed grain structure from the heat treatment and should have a strength which is essentially normal for the alloy. The grain size should preferably be of the order of 35 μm average diameter or larger.

The alloy sample is then subjected to mechanical working to distort the grains thereof.

The mechanical working can be by a cold working as by a forging or by a rolling or by a combination of cold working steps.

Alternatively, one or more steps of the working may be accompanied by a heating at a temperature below the recrystallization temperature. The heating is preferably of a type and to an extent which facilitates and enhances the deformation of the grains of the alloy sample.

Any heating which results in a recrystallization or refinement of the grain structure, should be avoided and, if it cannot be avoided entirely, then it should be minimized.

However, the sample may be given an aging heat treatment which does not result in recrystallization and which does not cancel the deformation of the grains. The alloy can be fully hardened to develop its full strength through aging treatment.

BRIEF DESCRIPTION OF THE DRAWINGS

In the description which follows clarity of understanding will be gained by reference to the accompanying drawings in which.

DETAILED DESCRIPTION OF THE INVENTION

In the copending application Ser. No. 907,275 it was brought out that it is possible to impart to nickel-base superalloys having relatively lower content of precipitate, desirable sets of properties, including low fatigue crack propagation rates. It was found and disclosed in the copending application that superalloys having lower concentrations of precipitate of the order 35 volume percent or less can be treated by thermomechanical processing to impart improvements to properties of the alloys and specifically to the fatigue crack propagation rate for the alloys.

However, this method was described as applied to existing alloys such as the IN718 alloy. There was no disclosure of an alloy which was found to have its properties particularly enhanced by thermomechanical processing. The subject application teaches an alloy which has been found to have the unique property of being particularly suited and adaptable to being benefitted by the application of thermomechanical processing essentially as taught in the copending application Ser. No. 907,275.

EXAMPLE 1

This example is essentially identical to Example 1 of U.S. Ser. No. 907,275 and deals with thermomechanical processing of a conventional alloy and specifically IN718.

Several IN718 heats were prepared by conventional vacuum induction melting. The melts were solidified and the ingots so formed were homogenized by heating at 1200° C. for 24 hours. The ingots were forged into plates according to conventional practice for nickel base wrought superalloys. The chemical composition of specific IN718 alloy employed in these examples is set forth in Table I below:

TABLE I

| Chemical Composition of Inconel 718 | |
|---|---|
| Element | wt. % |
| Ni | bal. |
| Cr | 19.0 |
| Fe | 18.0 |
| Mo | 3.0 |
| Nb | 5.1 |
| Ti | 0.9 |
| Al | 0.5 |
| C | 0.04 |
| B | 0.005 |

A metallographic study of the samples indicated that the IN718 alloy starts to recrystallize when subjected to a temperature higher than 950° C.

The forged plates were subjected to standard heat treatment including a solutioning at 975° C. for one hour and a double aging at 720° C. for eight hours. After the eight hour aging the samples were furnace cooled at 620° C. for an additional ten hours aging. The material of the resulting forged plates was found to have a recrystallized equiaxed grain structure of at least 35 μm average diameter. The strength of the forged samples was measured from room temperature up to 700° C. and was found to be similar in strength to that of standard reference material.

Figure 1:
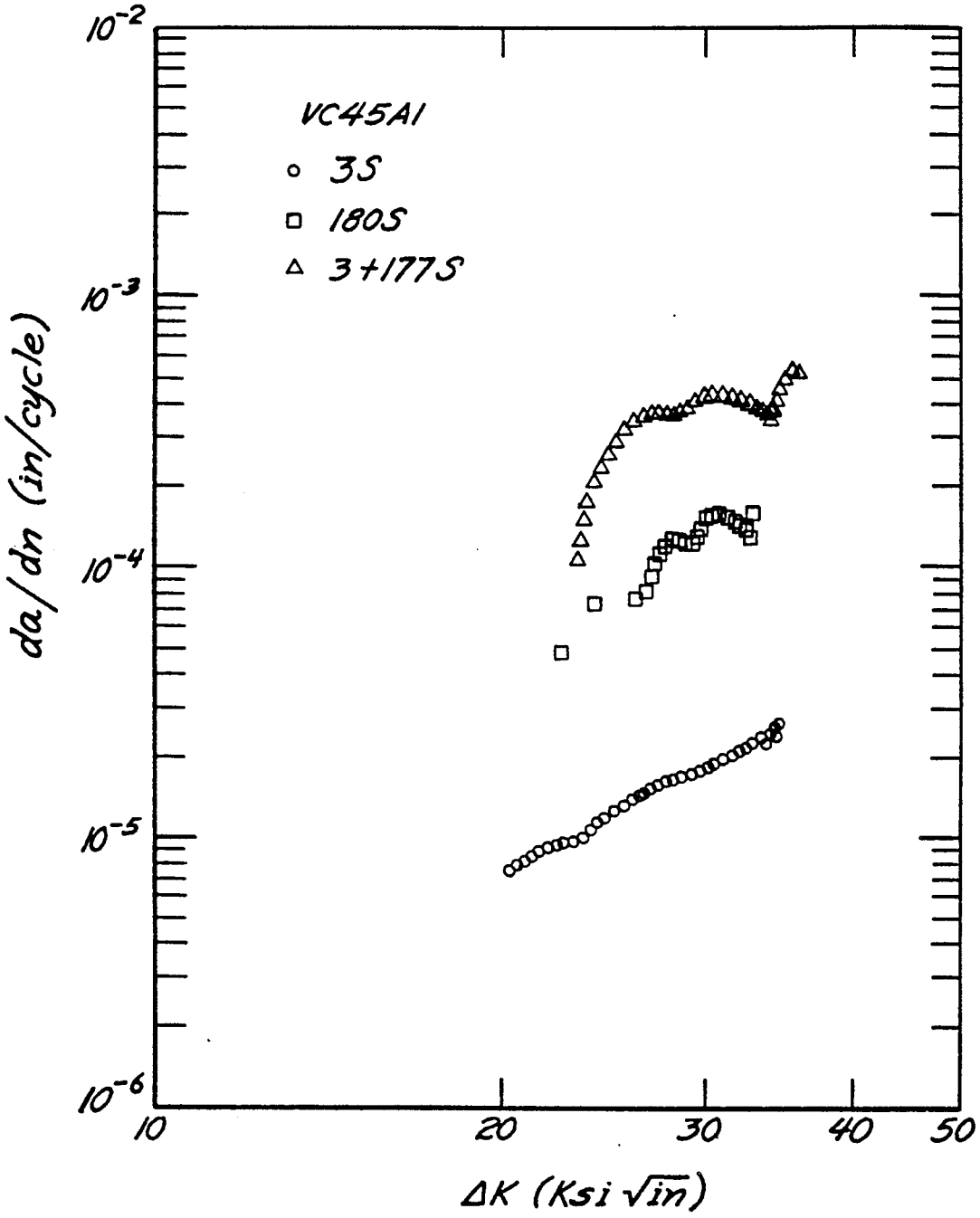
FIGS. 1-7 are graphic (log-log plot) representations of fatigue crack growth rates (da/dN) obtained at various stress intensities ($\Delta K$) for different alloy compositions at elevated temperatures under cyclic stress applications at a series of frequencies one of which cyclic stress applications includes a hold time at maximum stress intensity.

Time dependent fatigue crack propagation was evaluated at 593° C. using three different fatigue waveforms similar to those used in the NASA study. The first was a three second sinusoidal waveform and the second was a 180 second sinusoidal waveform. The third was a 177 second hold at the maximum load of three second sinusoidal cycle. The maximum to minimum load ratio was set $R=0.05$ so that the maximum was $20\times$twenty fold higher than the minimum load applied. Data was taken from the studies of the time dependent fatigue crack propagation and the data is plotted in FIG. 1. The results demonstrate and it can be observed from the plot that the crack growth rate da/dN increases by a factor of six to eight times when the fatigue cycle is changed from 3 seconds to 180 seconds. The hold time cycle accelerates the crack growth rate by a factor of 20.

EXAMPLES 2 and 3

This example pertains to the application of the process of copending application Ser. No. 907,725. to the commercially available alloy IN718 as taught in the copending application.

Plates were prepared as described in Example 1 of alloy IN718. The plates were prepared by vacuum induction melting followed by homogenization and forging as described in the Examples above.

For Example 2 an alloy plate so prepared was cold rolled 20%. Test data was taken of fatigue crack propagation rates for this 20% cold rolled sample and the results are plotted in FIG. 2.

For Example 3 an alloy plate prepared as described above was cold rolled through a 40% reduction in thickness. Fatigue crack propagation rate data was taken for this sample and the data is plotted in FIG. 3.

Figure 2:
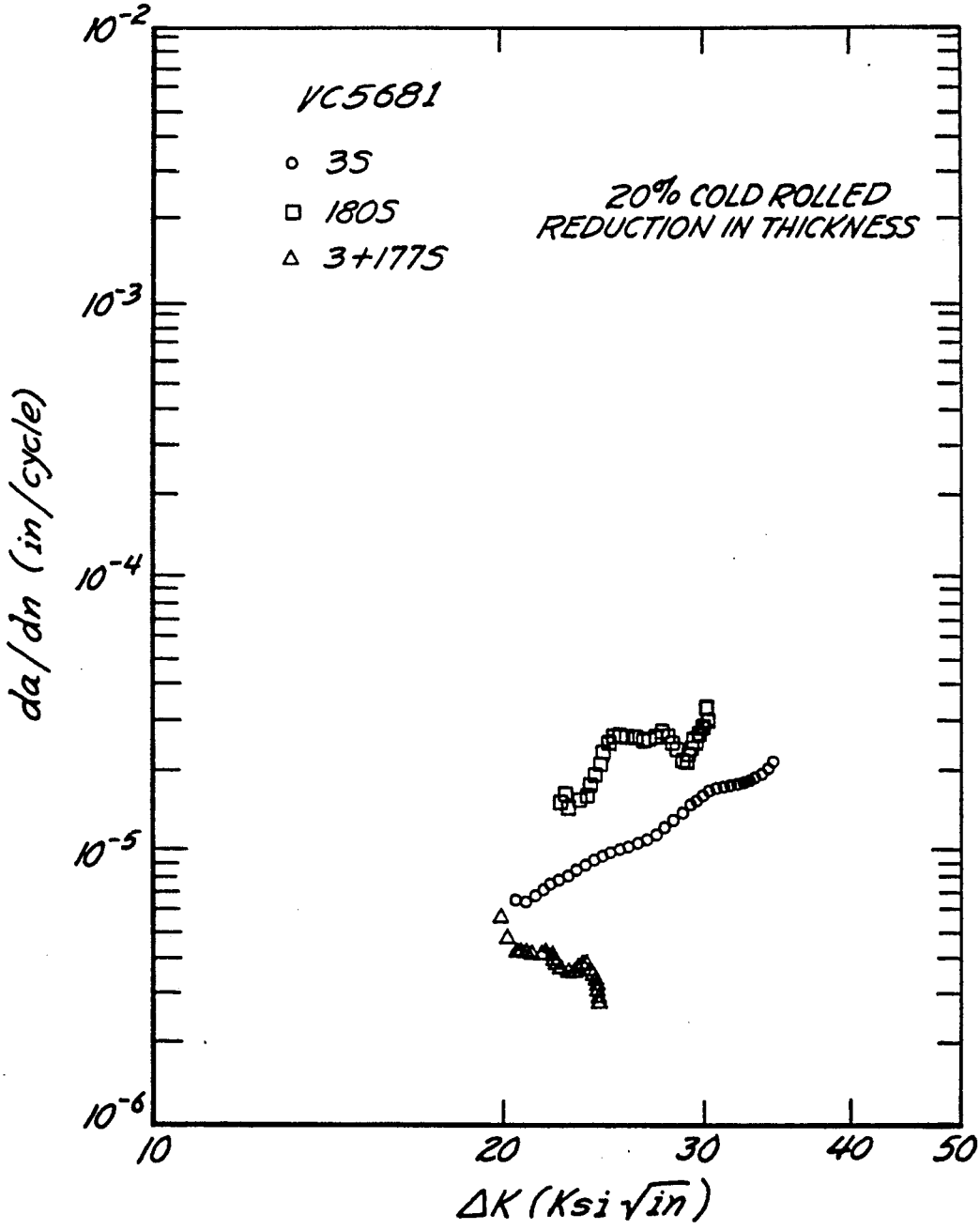
Figure 3:
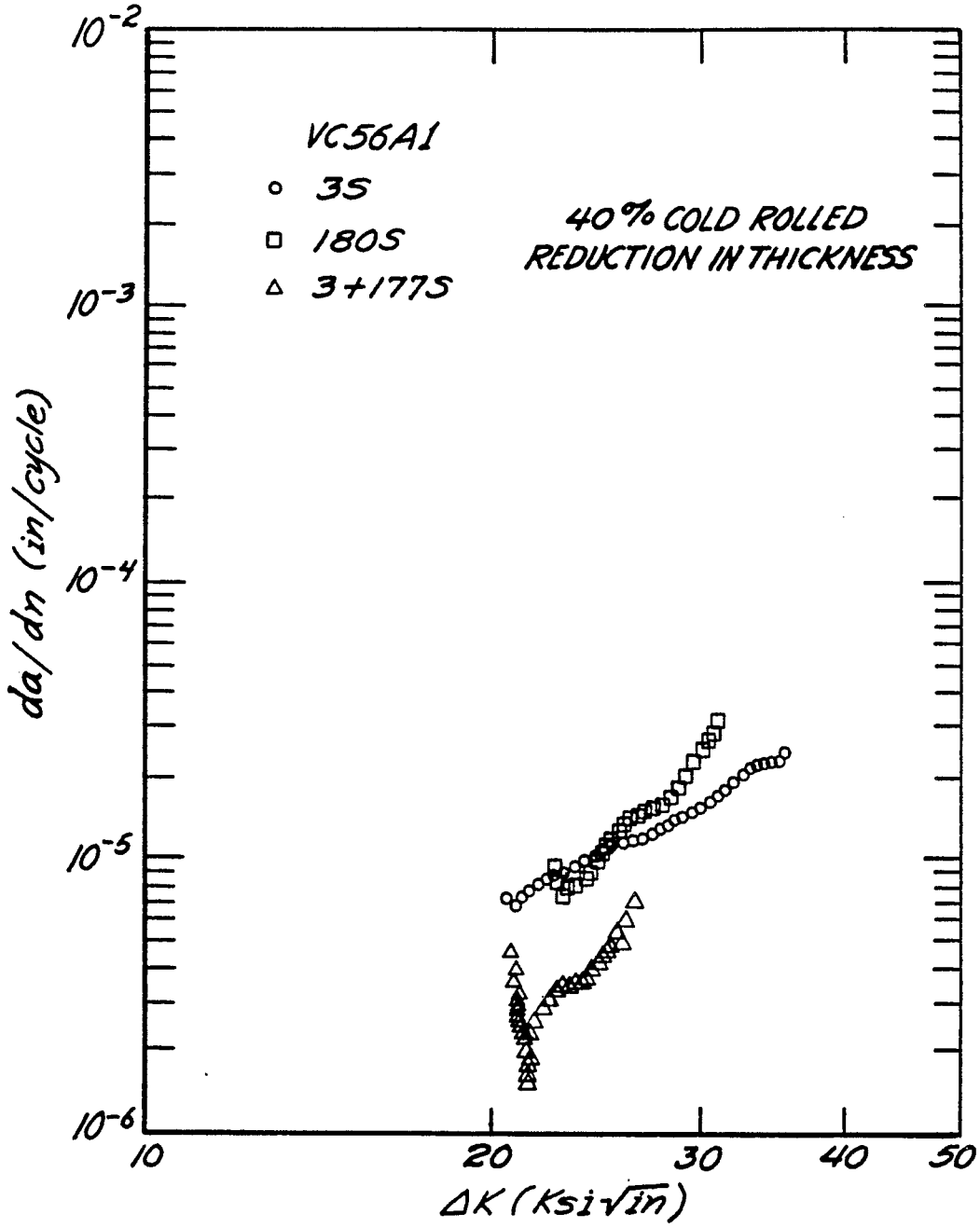

It will be observed from examination and consideration of FIGS. 2 and 3 that there is a significant improvement in the fatigue crack propagation time dependence. In other words the samples are found to be more independent of time relationships of the testing at the three different cycles and particularly at a 3 second cycle versus the 180 second cycle versus the 3 second cycle with the 177 second hold period at maximum load.

The method of this example was described as applied to existing alloys and specifically the IN718 alloy. There was no disclosure in copending application Ser. No. 907,275 of the discovery of an alloy specifically adapted to have its properties enhanced by thermomechanical processing. The subject application teaches a alloy which has been discovered to have the unique property of being particularly suited and adaptable to being benefitted by the application of thermomechanical processing essentially as taught in the copending application Ser. No. 907,275.

EXAMPLE 4

A sample of a different alloy was prepared for test. The procedures of sample preparation are set out below. The composition prepared had the composition as set forth in Table II.

TABLE II

| Ingredient | Nominal-CH84 Composition in wt % |
|---|---|
| Nickel | balance |
| Chromium | 12.00 |
| Cobalt | 18.00 |
| Molybdenum | 3.00 |
| Aluminum | 0.50 |
| Titanium | — |
| Tantalum | — |
| Niobium | 5.00 |
| Carbon | 0.015 |
| Boron | 0.01 |

The composition is described as nominal in that the ingredients were added to achieve the percentages which are listed in Table II. The composition was prepared by conventional vacuum induction melting. The melts were solidified and the ingots so formed were homogenized by heating at 1200° C. for 24 hours. The ingots were forged into plates according to conventional practice for nickel-base wrought superalloys.

The samples were then subjected to the thermomechanical processing as described in the copending application Ser. No. 907,275. In order to simplify the thermomechanical processing, the forged plates were subjected to different degrees of cold rolling. A 15% reduction by cold rolling was designated D. A 25% reduction by cold rolling was designated E and a 35% reduction in thickness by cold rolling was designated F.

Subsequent age treatments of 725° C. for 8 hours and a furnace cooling to 650° C. and heating for 10 hours at that temperature were applied to samples directly after the rolling.

The samples which were rolled to impart the three different degrees of reduction were then tested for fatigue crack growth rate. The fatigue crack growth rate was measured at 1100° F. by using three fatigue wave forms. A first being a 3 second sinusoidal cycle; a second being a 180 second sinusoidal cycle; the third being a 177 second hold cycle at the maximum load of a 3 second cycle. This fatigue crack growth rate measurements were essentially the same as those conducted in the copending application Ser. No. 907,275 and in Example 1 above.

Figure 4:
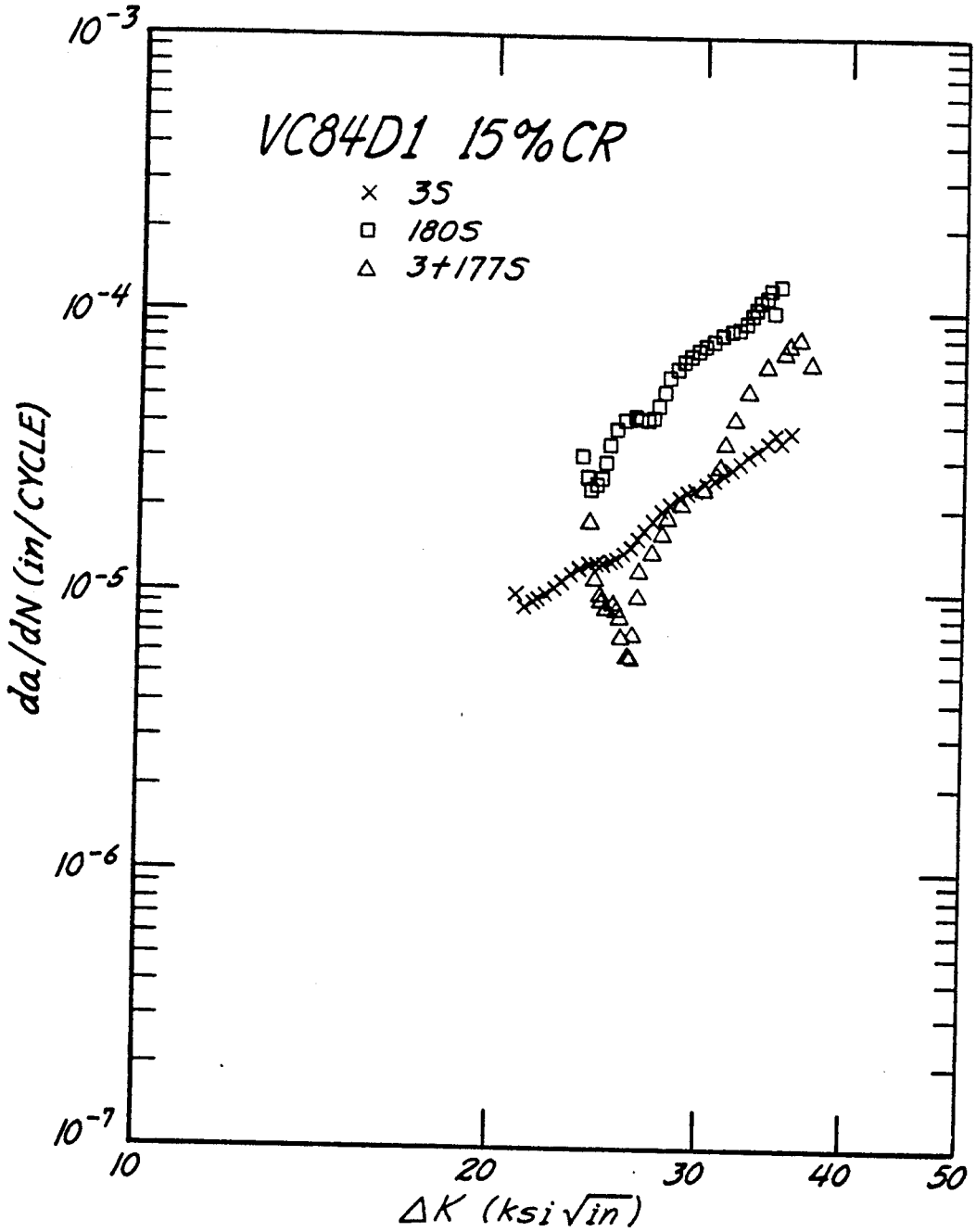
Figure 5:
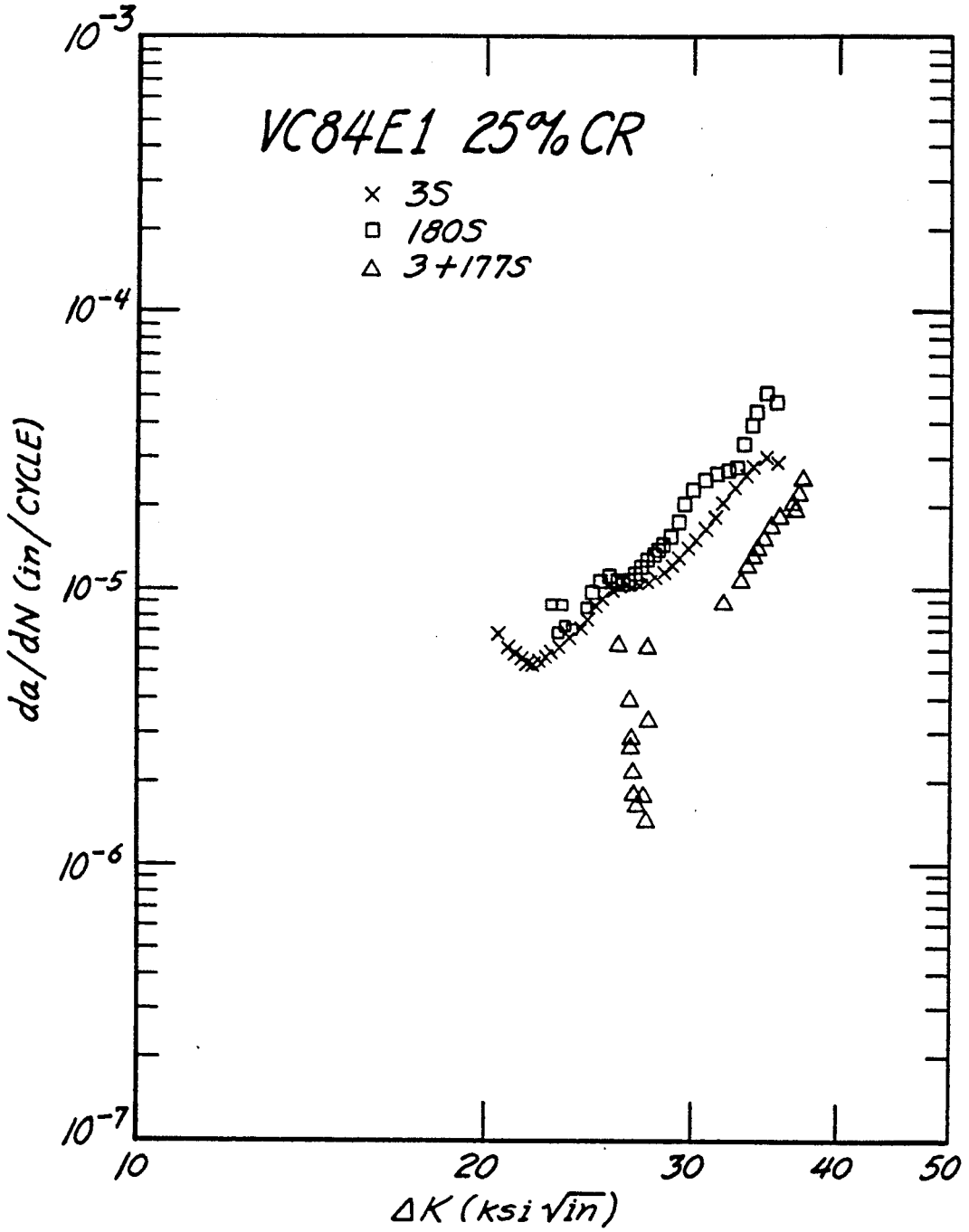

The results of the fatigue crack growth rate measurements for the sample D given the 15% cold roll reduction and the sample E given the 25% cold roll reduction are plotted in FIGS. 4 and 5. It is evident from FIGS. 4 and 5 that there was much less scatter of the test results based on the differences in the test cycle applied than there was for the test samples of Example 1 as these test results were plotted in FIG. 1. The reduction in scatter is similar to that found in the FIGS. 2 and 3 developed from the cold rolling reduction of the IN718 alloy specimen of Examples 2 and 3 above.

EXAMPLE 5

A heat was prepared to contain the composition as set forth in Table III below in parts by weight.

TABLE III

| Ingredient | CH83 Composition in wt % |
|---|---|
| Nickel | balance |
| Chromium | 12.00 |
| Cobal | 18.00 |
| Molybdenum | 3.00 |
| Aluminum | 0.50 |
| Titanium | 1.00 |
| Tantalum | 4.00 |
| Niobium | 4.00 |
| Carbon | 0.015 |
| Boron | 0.01 |

This composition contained the titanium and tantalum which where absent from the composition of Example 4 above. This composition is within the scope of the compositions taught in U.K. Patent Application GB2144323A.

The heat was processed through the preparation and thermal processing procedures as described in Example 1 above. The grains of the recrystallized alloy should preferably be at least 35 μm in average diameter.

Samples of the material were then subjected to thermomechanical processing as also described in Example 2 above. Again a sample given a 15% reduction by cold rolling was designated D. A 25% reduction by cold rolling was designated F and a 35% reduction in thickness by cold rolling areas designated F.

Figure 6:
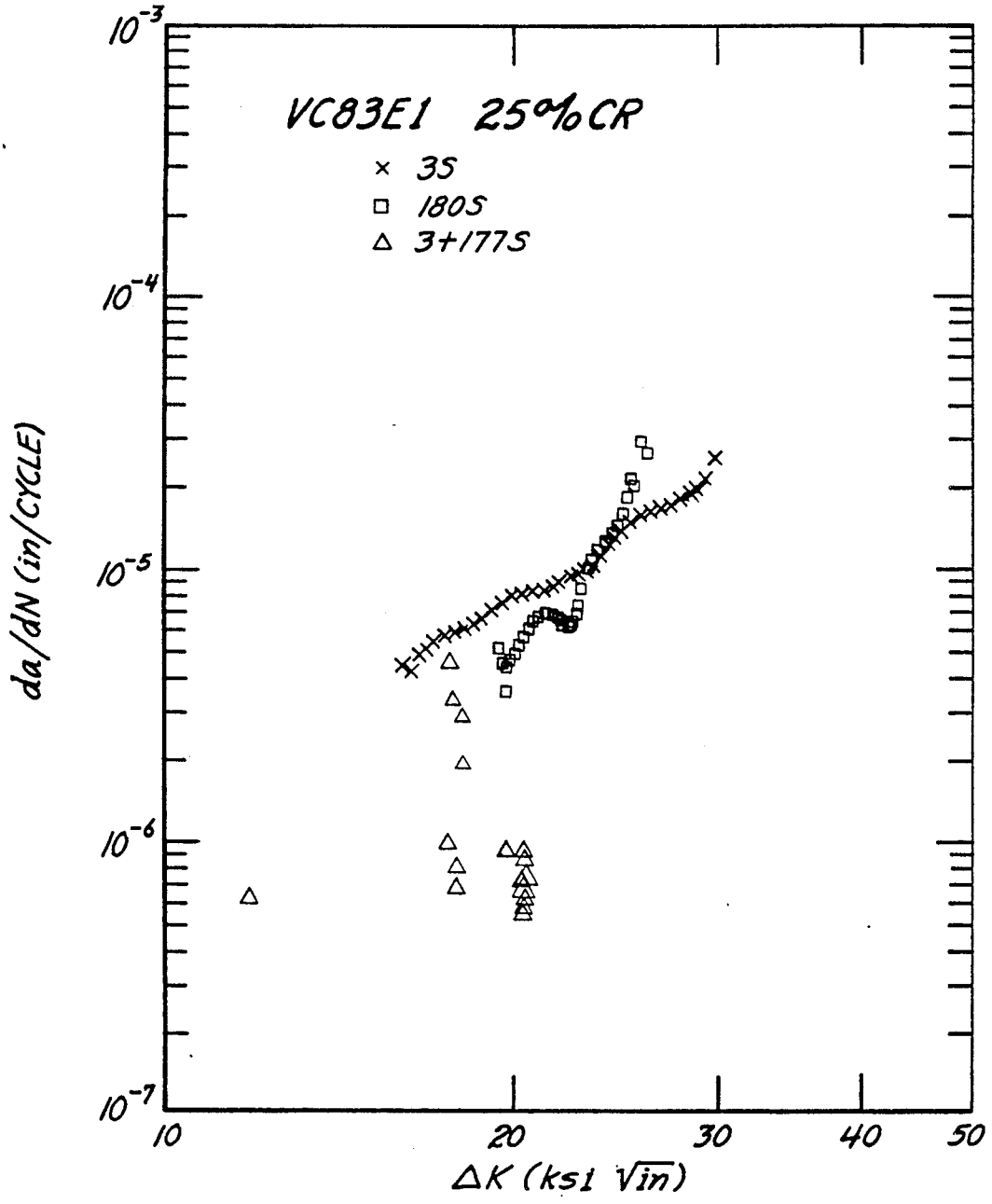
Figure 7:
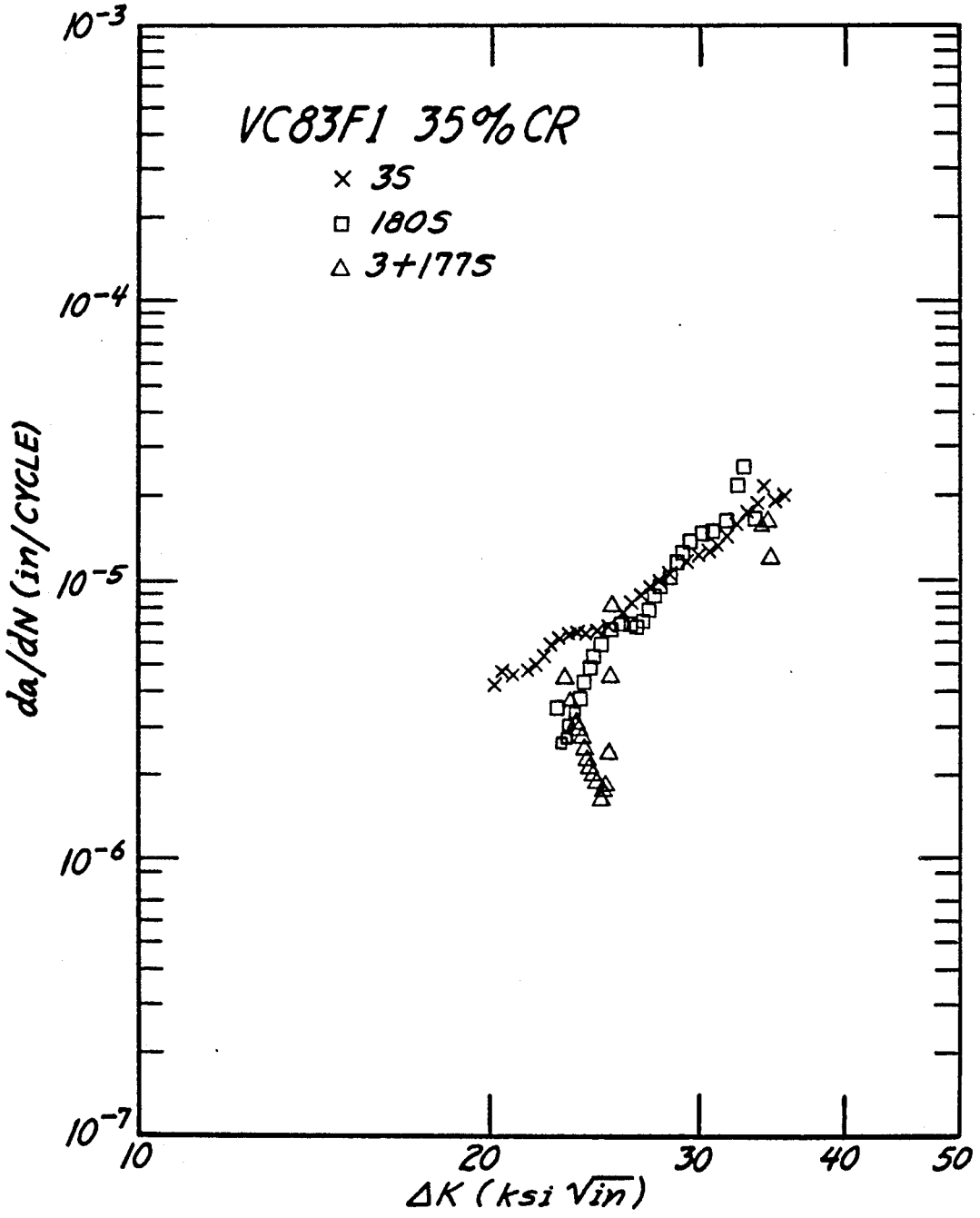

Samples of these thermomechanically processed alloys were subjected to fatigue crack propagation testing as described in Examples 1 and 2 and the results of the tests are plotted in FIGS. 6 and 7 for samples E and F. As will be evident from a study of the results plotted in FIGS. 6 and 7 there is very little time dependence of the fatigue crack propagation and accordingly very little scatter of the data points of the plot, and particularly of the data of FIG. 7 for the 35% cold rolled sample 83F.

EXAMPLE 6

The high temperature tensile properties of the alloys CH84 of Example 4 and CH83 of Example 5 were measured and the results are given in Table IV. Also in Table IV there is a listing of data which was obtained from measurements on samples of Inconel 718 which had been given a similar prerolling heat treatment followed by rolling reduction of 20 and 40% and a post rolling heat treatment essentially as described in the Examples 2 and 3 above. The tensile properties of each of the samples are listed in Table IV.

TABLE IV

| Test No. | Alloy %-CR | High Temperature Tensile Properties: Test Temp. (C) | Yield Strength (ksi) | Tensile Strength (ksi) | Elongation (%) |
|---|---|---|---|---|---|
| 1 | CH83D | 399 | 218.9 | 226.2 | 12.3 |
| | 15% | 593 | 207.1 | 220.4 | 9.6 |
| | | 704 | 190.1 | 190.0 | 24.8 |
| 2 | CH83E | 399 | 225.6 | 230.1 | 9.7 |
| | 25% | 593 | 220.0 | 230.9 | 5.9 |
| | | 704 | 198.4 | 206.1 | 27.2 |
| 3 | CH83F | 399 | 238.1 | 243.0 | 6.8 |
| | 35% | 593 | 219.8 | 229.7 | 7.6 |
| | | 704 | 205.3 | 212.2 | 24.8 |
| 4 | CH84D | 399 | 163.3 | 180.9 | 20.0 |
| | 15% | 593 | 145.9 | 166.5 | 14.3 |
| | | 704 | 138.9 | 154.2 | 34.3 |
| 5 | CH84E | 399 | 171.5 | 186.2 | 15.9 |
| | 25% | 593 | 163.3 | 186.3 | 14.6 |
| | | 704 | 157.0 | 165.9 | 33.5 |
| 6 | CH84F | 399 | 182.4 | 194.1 | 13.8 |
| | 35% | 593 | 164.5 | 180.6 | 12.2 |
| | | 704 | 155.3 | 165.2 | 33.4 |
| 7 | IN718 | 649 | 187.8 | 195.9 | 10.8 |
| | 20% | 704 | 169.4 | 177.6 | 18.4 |
| 8 | IN718 | 649 | 193.7 | 201.9 | 10.8 |
| | 40% | 704 | 187.2 | 194.9 | 25.0 |

Referring now to Table IV the strength of the alloys IN718, CH84 and CH83 are compared.

Comparison is based initially on the comparison of the results of tests 2, 5 and 7. The reason for this comparison is that the degree of cold rolled reduction in thickness if comparable for these three tests. Test 2 involved testing after a 25% reduction of alloy CH83. Test 5 involved testing after a 25% reduction of alloy 84 and test 7 involved testing after a 20% reduction of alloy IN718.

At 704° C. the yield strength found for alloy IN718 of test 7 is substantially stronger than the CH84E alloy of test 5 by about 12 ksi. However the 704° C. yield strength of the alloy 83E is very surprisingly higher than that of the alloy 718 of test 7 and is in fact about 30 ksi higher.

The significance of a 30 ksi gain in yield strength can be appreciated that this represents about the total yield strength of conventional stainless steels.

The 704° C. tensile strength of the same alloys follows the same pattern with the CH84B alloy showing substantially lower tensile strength (about 10 ksi) than the IN718 and with the CH83B alloy of test 2 displaying a surprisingly greater tensile strength than the comparable IN718 alloy sample of test 7.

In essentially all tests made the CH83 alloy displayed substantially higher strength than the IN718 alloy while at the same time displaying fully adequate ductility.

From the results listed in Table IV, it is clear that the alloy CH83, which contains tantalum as a hardening element, shows excellent tensile strengths up to about 704° C. In contrast to the excellent tensile properties of the CH83 alloy, the CH84 alloy which contained no tantalum has much poorer tensile properties and is much weaker than the CH83 alloy. Further, it can be observed from the results listed in Table IV that the CH84 alloy which contains no tantalum is weaker than the Inconel 718 even though the CH84 has about the same level of hardening elements. Hardening element additions are commonly known, and known from the Eiselstein patent U.S. Pat. No. 3,046,108 to be aluminum, titanium and niobium.

Further tests results were obtained for the alloys. In particular, stress rupture results were obtained by conventional stress rupture measurements and the results are plotted in FIG. 8.

The new alloys CH83 and CH84 exhibit the obvious advantage of temperature capability over Inconel 718. The alloy CH83 with the tantalum additions has an approximately 100° F. temperature capability improvement over that of the Inconel 718 alloy.

Figure 8:
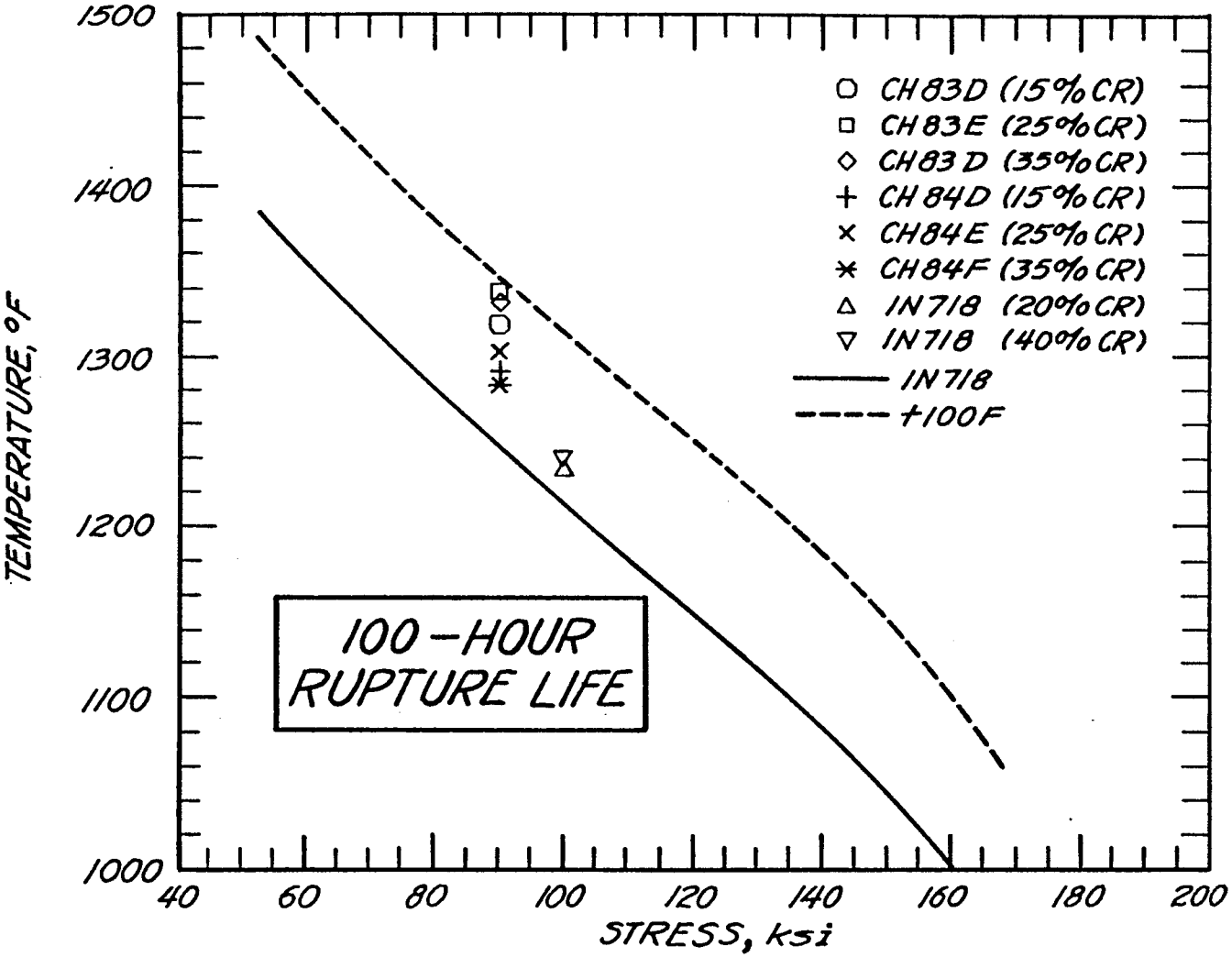
FIG. 8 is a graph in which temperature in degrees F is allotted against stress in ksi and displaying 100 hours rupture life values for alloys given different thermomechanical processing treatments.

With further reference to FIG. 8 the IN718 alloy rupture life is seen to increase slightly for the alloy cold rolled 40% over the alloy cold rolled 20%. As the inverted triangle (for 40%CR) stands above the upright triangle (for 20%CR). The +, x and * data points for the CH84 alloy are substantially above the triangles of the IN718 alloy. The square, diamond and octagon data points for the CH83 alloy are substantially above the CH84 data points and are quite far above the IN718 triangle data points. This and other rupture life data confirm that the CH83 alloy has a 100° F. temperature advantage over the IN718 alloy.

What is claimed and sought to be protected by Letters Patent of the United States is as follows:

1. A structural article having high strength and low fatigue crack propagation rate which comprises an article formed of a composition consisting essentially of the following in parts by weight:

| Ingredient | Concentration: From About | To About |
|---|---|---|
| Nickel | balance | |
| Chromium | 16 | 22 |
| Cobalt | 8 | 14 |
| Molybdenum | 2.0 | 4.0 |
| Aluminum | 0.2 | 0.9 |
| Titanium | 0.5 | 1.5 |
| Tantalum | 3.5 | 4.5 |
| Niobium | 3.5 | 4.5 |
| Carbon | 0.0 | 0.05 |
| Boron | 0.002 | 0.015 |

the composition having been recrystallized and aged and having grains of minimum average diameter of about 35 microns, and the grains of the article being deformed by a mechanical working to change the shape of the article by at least 15%.

2. The article of claim 1 in which the change in shape is at least 20%.

3. The article of claim 1 in which the change in the shape is at least 25%.

4. The article of claim 1 in which the change of shape is at least 35%.

5. A structural article having high strength and low fatigue crack propagation rate which comprises an article formed of a composition consisting essentially of the following in parts by weight:

| Ingredient | Concentration |
|---|---|
| Nickel | balance |
| Chromium | 12 |
| Cobalt | 18 |
| Molybdenum | 3 |
| Aluminum | 0.5 |
| Titanium | 1 |
| Tantalum | 4 |
| Niobium | 4 |
| Carbon | 0.015 |
| Boron | 0.01. |

the composition having been recrystallized and aged and having grains of minimum average diameter of about 35 microns, and the grains of the article being deformed by a mechanical working to change the shape of the article by at least 15%.

* * * * *